US007988764B2

(12) United States Patent
Birol et al.

(10) Patent No.: US 7,988,764 B2
(45) Date of Patent: Aug. 2, 2011

(54) PROCESS FOR PRODUCING A GRAIN REFINING MASTER ALLOY

(75) Inventors: Yucel Birol, Kocaeli (TR); Osman Cakir, Kocaeli (TR)

(73) Assignee: TUBITAK, Ankara (TR)

( * ) Notice: Subject to any disclaimer, the term of this patent is extended or adjusted under 35 U.S.C. 154(b) by 424 days.

(21) Appl. No.: 12/092,071

(22) PCT Filed: Jan. 23, 2006

(86) PCT No.: PCT/IB2006/050240

§ 371 (c)(1),
(2), (4) Date: Apr. 29, 2008

(87) PCT Pub. No.: WO2007/052174

PCT Pub. Date: May 10, 2007

(65) Prior Publication Data

US 2008/0245447 A1 Oct. 9, 2008

(30) Foreign Application Priority Data

Nov. 2, 2005 (TR) ..... A 2005 04376

(51) Int. Cl.
*C22C 1/02* (2006.01)

(52) U.S. Cl. ..... 75/685; 75/10.49; 75/10.65; 148/437

(58) Field of Classification Search ..... 75/10.21, 75/10.49, 10.65, 678, 684, 685; 148/437
See application file for complete search history.

(56) References Cited

U.S. PATENT DOCUMENTS

| | | | | |
|---|---|---|---|---|
| 5,100,618 | A * | 3/1992 | Dewing et al. | 420/528 |
| 5,484,493 | A | 1/1996 | Young et al. | |
| 2003/0075020 | A1 * | 4/2003 | Hotz et al. | 75/684 |

FOREIGN PATENT DOCUMENTS

| | | |
|---|---|---|
| EP | 0396388 | 11/1990 |

* cited by examiner

*Primary Examiner* — George Wyszomierski
*Assistant Examiner* — Mark L Shevin
(74) *Attorney, Agent, or Firm* — Venable, Campillo, Logan & Meaney PC

(57) ABSTRACT

A process is provided for producing an aluminium-titanium-boron grain refining master alloy containing titanium boride and titanium aluminide particles, the process comprising melting aluminium in a silicon carbide crucible in a medium frequency induction or an electric resistance furnace, adding to the melt at a temperature between 750 degrees Celsius and 900 degrees Celsius, $KBF_4$ and $K_2TiF_6$ salts, pre-mixed in proportions to obtain a Ti/B ratio of 5 in the melt, gently mixing the salt mixture with the melt without introducing any stirring, transferring the molten alloy to an electric resistance furnace maintained at 800 degrees Celsius, decanting the K—Al—F salt, the by-product of the salt reaction, thoroughly stirring the molten alloy in the SiC crucible with graphite rods before finally casting the molten alloy into cylindrical molds in the form of billets and finally extruding the billet into 9.5 mm rods.

8 Claims, 1 Drawing Sheet

[Fig. 1]
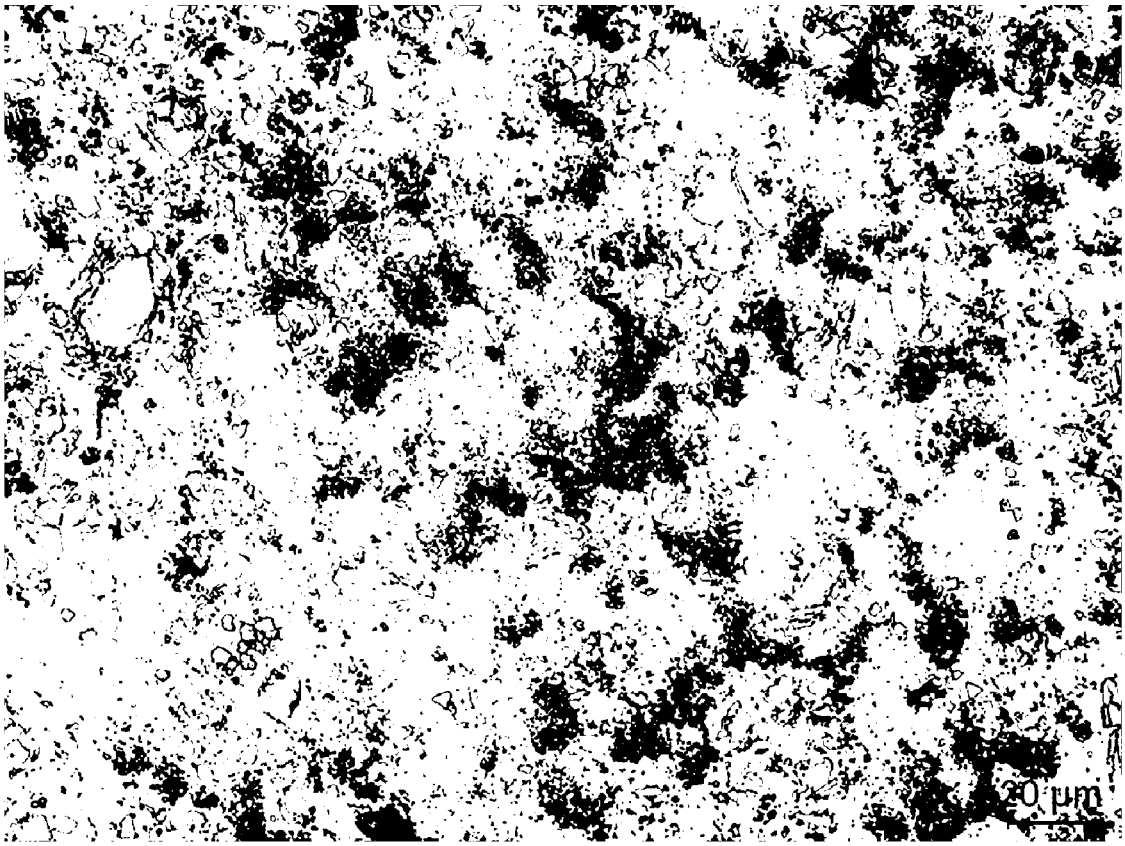
[Fig. 2]
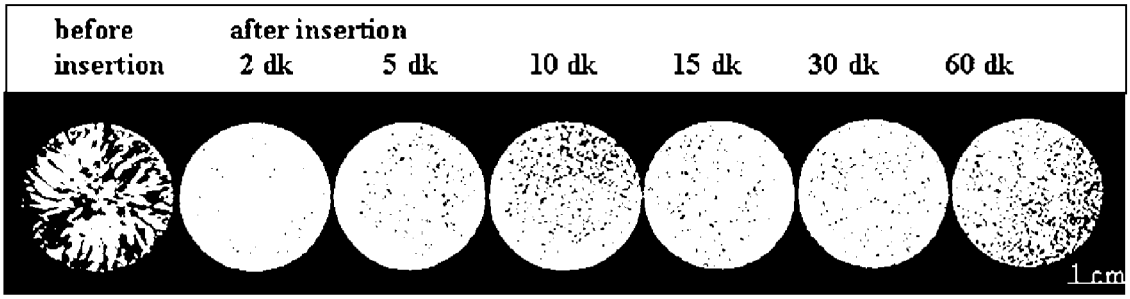

PROCESS FOR PRODUCING A GRAIN REFINING MASTER ALLOY

RELATED APPLICATIONS

The instant application is the U.S. National Phase under 35 U.S.C. §371 of International Application No. PCT/IB06/50240, filed on Jan. 23, 2006, which in turn claims the benefit of Turkish Application No. 2005/04376, filed on Nov. 2, 2005, the disclosures of which are incorporated by reference herein in their entireties.

TECHNICAL FIELD

The present invention relates to a process for producing aluminium-titanium-boron master alloys for use in the promotion of uniform small grains in aluminium castings, ingots, slabs and strips.

BACKGROUND ART

The grain size in aluminum castings, e.g. ingots, slabs, strips is an important industrial consideration and it is almost always advantageous to provide a high degree of grain refinement. It has thus become a common practice in recent years to add master alloys to molten aluminium in order to achieve fine, equiaxed grains after solidification which otherwise tend to be coarse and columnar. A fine, equiaxed grain structure imparts to a casting, high toughness, high yield strength, excellent formability, good surface finish and improved machinability. Furthermore, a sound grain-refining practice avoids hot tearing and porosity which can result from the occurrence of large columnar grains, allows a marked increase in casting speed and improves the homogeneity of the cast structure by refining the distribution of secondary phases. The use of grain-refining alloys in casting of ingots, billets and strip, has thus become a standard practice in aluminium foundries worldwide.

It is well known that addition of titanium to aluminum alloys causes grain refinement of the resulting castings through nucleation of alpha aluminum by the primary $Al_3Ti$ phase via the peritectic reaction. Additions of boron were shown, by the seminal work of Cibula in the late 1940's, to remarkably improve grain refinement of aluminum by titanium at hypoperitectic concentrations. As a result, Al—Ti—B master alloys emerged as potential grain refiners for aluminum alloys. At present, there is a variety of commercial grain refiners of this type as well as comprehensive literature on this system and its implications on the grain refinement. The microstructure of these alloys consists of $TiB_2$ and $Al_3Ti$ particles in an aluminium matrix with extremely small amounts of Ti and B in solution. When Al—Ti—B master alloys are added, the aluminum matrix dissolves and these particles which subsequently act as heterogeneous nucleation sites are released into the melt. The mechanism of grain refinement by Al—Ti—B master alloys involves segregation of solute Ti onto the $TiB_2$/melt interface accompanied by the formation of an interfacial layer which takes part in the nucleation process (Mohatny 4-7). Extensive detailed discussion on theories of grain refinement can be found in the literature (Mohatny 2-8). The use of AlTiB type master alloys for grain refinement of aluminum alloys today is an established procedure and has become widespread in the aluminum foundry industry.

Aluminum grain refiner alloys consist typically of 2-12 wt % titanium and 0.1-2 wt % boron, the balance being commercial grade aluminum with normal impurities. Examples of these alloys are disclosed in U.S. Pat. Nos. 3,785,807, 3,857,705, 4,298,408 and 3,634,075. Various methods for the production of Al—Ti—B grain refiner master alloys have been described in numerous patents (Murty 24-31) as well as in the open literature (Murty 3, 15, 23, 42-48).

The invention outlined in U.S. Pat. No. 6,228,185 teaches a process for making a castable aluminium-based matrix melt, by reacting, within an aluminium-based melt, precursor compounds, so as to produce boride ceramic particles dispersed in the melt. The preferred precursors are potassium borofluoride, KBF4, and potassium hexafluorotitanate, K2TiF6. The two salts are fed to the aluminium-based melt at a controlled rate, while maintaining stirring of the melt. Another technique reported in GB-A-2,257,985, GB-A-2,259,308 and GB-A-2,259,309, referred to as the reactive casting technique, also uses a mixture of $K_2TiF_6$ and $KBF_4$ in contact with molten aluminium to form and disperse the TiB2 particles in the molten alloy.

While KBF4 is conventionally employed as the commercial source of boron, alternative sources for boron have also been identified. The process described in U.S. Pat. Nos. 5,415,708 and 5,484,493 involves adding a boron containing material selected from the group consisting of borax, boron oxide and boric acid and their mixtures plus K2TiF6 to a bath of molten aluminum and stirring the molten mixture to produce an aluminum base alloy consisting essentially of from 0.1 to 3.0% boron, from 1 to 10% titanium.

Sources of titanium other than K2TiF6, include titanium sponge, titanium turnings and titanium oxide. U.S. Pat. No. 3,961,995 describes a process for producing Al—Ti—B alloys by reacting liquid aluminum with titanium oxide and boron oxide in solution in molten cryolite and quenching the alloy rapidly to cool and solubilize the reaction product. Zhuxian et al (Murty: 53, 54) have prepared Al—Ti—B master alloys by the thermal reduction and electrolysis of titanium dioxide and diboride trioxide in cryolite alumina melts in the presence of aluminum at 1000C. Sivaramakrishnan et al. (Murty: 49-52) have successfully prepared Al—Ti—B master alloys by the reaction of B2O3 and TiO2 with molten aluminum. However, this method requires high operating temperatures generally in excess of 1000C. Krishnan et al (Murty: 59) have melted aluminum and titanium sponge together and allowed the melt to react with KBF4 in order to prepare Al—Ti—B master alloy.

In the process described in French Patent Specification No. 2,133,439, two aluminum masses, one containing dissolved titanium and the other dissolved boron, are contacted at elevated temperature (above 1000C.), resulting in the formation of titanium diboride crystals which are insoluble in the aluminum. The mixture then has to be intensively cooled in order to avoid growth of the TiB2 crystals, which reduces the effectiveness of the master alloy. Accordingly, mixing of the two molten masses and cooling have to be carried out at virtually the same time, which necessitates expensive apparatus, both for mixing and for cooling, so that it is only possible to use very small batches at a time.

Among the above techniques, that involving the reaction of halide salts with molten aluminium is the most popular. This technique uses low melt temperatures (750-800) compared to thermal reduction (1000C.) and utilises the exothermic nature of the reaction between the salts and the molten aluminum. Al—Ti—B grain refiner alloys according to this technique are conventionally produced batchwise in an electric induction furnace. The alloying ingredients, typically provided in the form of the double fluoride salts of titanium and boron with potassium in the required proportion are fed to a stirred body of molten aluminum in an induction furnace between 700.-800C. The salt mixture is drawn below the surface of the melt by means of an electromagnetic stirring action, and are reduced to Ti and B by Al. These complex salts react with liquid aluminium quickly and very efficiently producing a melt with dispersed particles of $Al_3Ti$ and $(Al,Ti)B_2$ and high yields of Ti and B in the final alloy [4, 5, 7, 9]. Measures are taken to allow the reaction product, molten potassium aluminum fluoride, to rise to the surface of the melt where it forms a discrete layer which is then removed by decanting. The batch of molten alloy thus obtained may be transferred to a separate casting furnace which is typically an electric induction furnace where electro-magnetic stirring helps to keep the insoluble $TiB_2$ particles suspended in the melt. The alloy may be cast into either an ingot for further working to rod by rolling or by extruding or directly into a rod casting machine, such as a Properzi caster.

In addition to the batch process, there are several methods to produce AlTiB grain refiners continously. Such a continous process is described in U.S. Pat. No. 5,100,618 for producing an Al—Ti—B grain refiner. U.S. Pat. No. 5,057,150 also discloses a process for the production of an Al—Ti—B grain refining rod, in which molten aluminum is continuously passed through a confined reaction zone. Titanium and boron precursor compounds, e.g. salts, are continuously added to the molten aluminum in the reaction zone and the content of the reaction zone is continuously stirred to submerge the salts within the aluminum melt. The molten alloy formed is continuously transferred via a transfer conduit from the refining zone to a casting station.

A recent work has indicated that holding the master alloy melt at approximately 750° C. for several hours after the salt reaction is complete, produces master alloys having very good grain refining properties [5, 17, 22, 23]. U.S. Pat. No. 4,612,073 discloses a new aluminum grain refiner alloy with a controlled, effective content of 'duplex' crystals which are claimed be extremely potent grain refining agents. The duplex crystals are made by producing aluminides that contain boron in solution, and then by aging this aluminide in a manner to precipitate at least part of the boron to form the duplex crystals.

Several patents (U.S. Pat. Nos. 3,785,807 and 3,857,705) have disclosed concepts to obtain improved grain refining alloys by controlling the morphology of the $TiAl_3$ crystals. These disclosures are often contradictory and do not clearly solve the problems.

During the investigation of existing grain refiners and testing of various alloys and methods described in the prior art, it became apparent that two batches of the same product, apparently produced in nearly the same manner and with nearly the same bulk chemistry, behave differently when used as a grain refiner. Besides, certain difficulties are involved in processing Al—Ti—B master alloys, and the results obtained in regard to grain refinement differ very appreciably, according to the composition of the alloy and its method of preparation. This could at least in part, be due to the fact that the microstructure and the performance of a grain refiner are highly sensitive to the processing parameters used in the production of the master alloy [1, 3].

DISCLOSURE

The present invention relates to a process for the production of Al—Ti—B grain refiner master alloys, containing from 1 to 10% titanium and from 0.1 to 3.0% boron, and the balance essentially aluminum, wherein the resultant alloy contains TiAl3 particles having a diameter of less than 50 microns and TiB.sub.2 particles dispersed throughout having an average particle size of less than 1 micron; capable of providing an average grain size of less than 200 microns at contact times of upto 60 minutes. This invention also relies on the reaction of halide salts with molten aluminum to produce Al—Ti—B grain refiner master alloys, yet is different from those disclosed in the prior art as it allows the by-product of the salt reaction to remain on the surface of the molten Al—Ti—B alloy until before casting in order to avoid oxidation of the molten alloy during holding which was found to contribute to the grain refining performance of the grain refiner master alloy.

A set of experiments were conducted in an effort to identify which parameters of the manufacturing cycle were highly critical to ensure an adequate grain refining efficiency in Al—Ti—B alloys. The manufacturing cycle was considered to consist of three distinct, consecutive steps: melting the aluminium ingot; adding the fluoride salts into the melt and establishing a reaction between these salts and the aluminium melt (step 1: salt addition); holding the melt under pre-determined conditions (step 2: holding) before finally decanting the salt residue and casting the melt into a permanent mold after thorough-mixing (step 3: casting). The last step was practically the same in all experiments while the first step involved either induction melting or resistance furnace melting. The parameters from each of the above steps was made to vary one at a time in order to isolate the effect of each parameter on the grain refining efficiency.

The microstructures and the grain refining performances of the two alloys produced through melting in a medium frequency induction and an electric resistance furnace, the following steps being identical, were very similar. It is thus concluded that the melting technique employed in the manufacture of grain refiner alloy bears no significance with regard to its grain refining efficiency, as one would expect. Steps 1 and 2, referred to as 'addition-reaction' and 'holding', respectively, on the other hand, were found to have an impact on the grain refining efficiency of the Al—5Ti—1B master alloy. The temperature at which the salt mixture is added (reaction temperature), the way they are added (addition practice-reaction time), stirring during reaction in step 1; holding temperature, holding time and stirring during holding in step 3 strongly influenced the grain refining efficiency of Al—Ti—B master alloys prepared by the salt route.

The salt addition practice appeared to have a big impact on the grain refining performance of the master alloy. Very poor results with columnar grains near the edges and coarse equiaxed grains in the center were obtained when the $KBF_4$ salt was added to the melt first. Addition of the $K_2TiF_6$ salt first instead, has produced a much better grain refining performance which, however, improved further when the salts were pre-mixed before addition. A slight deterioration in the grain refining performance was noted particularly at longer contact times when the salt mixture was melted first and then added to the aluminium melt as a liquid. It is fair to conclude that the grain refining efficiency of the master alloy was best when the $KBF_4$ and $K_2TiF_6$ salts were pre-mixed before they were added to the aluminium melt in production.

The pre-mixed salts were added and reacted with the aluminium melt at several temperatures between 750° C. and 900° C. The rest of the production cycle involved holding of the melt between 750° C. and 800° C. for 30 minutes in an electric resistance furnace without introducing any stirring until casting. The last step (step 4) was performed as described earlier. The microstructures and the grain refinement performance test results of the Al—5Ti—1B master alloys thus produced were almost identical. The grain sizes 2 minutes after inoculation with these alloys was approximately 150 microns and remained very fine throughout the entire performance test. It was thus concluded that the reaction temperatures between 750° C. and 900° C. had no significant effect on the grain refining efficiency and that all were fine.

The reaction time was made to vary by adding the salt mixture to the melt either at once or gradually over a period of time. The salt reaction lasted almost 20 minutes in the latter practice but only a few minutes in the former. The effect of reaction time on the grain refining performance appeared to be only minor. The inoculated grain sizes were slightly finer when the salt mixture was added to the aluminium melt at once instead of gradually over a period of time. As the reaction between the fluoride salts and the aluminium melt is strongly exothermic, the rate of salt addition is expected to affect the reaction step also temperature-wise. Hence, the gradual salt addition practice was repeated at a melt temperature of 850° C. in order to compensate for the loss of melt heating in the case of gradual addition. The difference in the inoculated grain sizes were now even larger, in favor of the shorter reaction time, possibly due to the higher holding temperature, as will be discussed later. It was thus concluded that the grain refining performance of the master alloy is superior when the salt mixture is added at once so as to allow the salt reaction to occur rapidly.

The master alloy produced by gently mixing the salt with the melt produced very fine grains after inoculation with a rather long lasting refinement effect contrasting the grain refining performance of the alloys produced by introducing a mechanical stirring action during salt addition. The stirring action provided in the course of salt addition was thus claimed to have a detrimental effect on the grain refining efficiency of the master alloy. Similar results were obtained when the salt mixture was added to the aluminium melt in an induction furnace where magnetic, instead of mechanical, stirring was available.

Holding the melt after the reaction between aluminium melt and the salt mixture is over was found to have an impact on the grain refining efficiency of the master alloy. Manufacture of Al—5Ti—1B alloy without any holding is associated with rather poor grain refining efficiency. Low Ti recoveries in the case of 'no holding' is believed to be responsible, at least in part, for the poor performance of this alloy. The grain refining performance improves with increasing holding time until 15 minutes during production. Holding between 15 and 30 minutes yields a master alloy which does a great job of refining the cast grain structure. Longer holding does not seem to offer any improvement in the grain refining properties of the master alloy and is thus not necessary. This finding of the present work contrasts that of Guzowski et al. (Guzowski MT87), who claimed that the grain refining response improved when the master alloys were held for an appreicable time (upto 2 hours) after the chemical reaction between the salts and the aluminium melt.

Having identified an optimum holding time for an adequate grain refining efficiency, additional experiments were performed to find out about the effect of holding temperature on the performance of the grain refiner alloy. The aluminium melt, reacted with the fluoride salts, were held at several temperatures between 750° C. and 900° C. for 30 minutes once the salt reaction was over. The microstructural features and the grain refining performances of the Al—5Ti—1B alloys produced by holding the melt at 750° C. and 800° C. were almost identical. The grain size was very fine throughout the entire test in both cases. There was a slight degradation in the grain refinement effect when the melt was held at 850° C. after the salt reaction. Loss in the grain refining effect has become very prominent when the holding temperature was increased further to 900° C. It was thus concluded that the grain refining efficiency was adversely affected with increasing holding temperatures above 800° C. and was largely impaired after 850° C.

Stirring during holding at 800° C. for 30 minutes was introduced by both mechanical and magnetic means (induction furnace). Inoculation with the Al—5Ti—1B alloys produced by stirring during holding failed to give fine equiaxed grains across the section and has produced rather coarse columnar grains near the edges. The mechanical and magnetic stirring action employed during holding clearly had a very detrimental effect on the grain refining efficiency of the master alloy. The alloy produced by holding the melt without stirring, on the other hand, produced very fine grains after inoculation even at long contact times. The loss of grain refining effect in the case of stirring during holding is believed to be associated with the mixing of the salt residue ($KAlF_4$) with the melt. Agglomeration of $TiB_2$ particles was found to occur due to the wetting of the boride particles by the potassium cryolite salt leading to poor grain refining efficiency [24].

Mechanical working revised the microstructural features of the grain refiner alloys by improving the homogeneity of the $TiAl_3$ and $TiB_2$ dispersion and had only a favorable effect on their grain refining efficiency of the master alloys.

It is quite clear that the stirring action provided during reaction and holding steps works against an adequate grain refining performance. Likewise, reaction and holding temperatures in excess of 800° C. impair the grain refining properties. A short, instead of a long reaction time, on the other hand, improves the grain refining performance. In view of the above, a sound process to produce a Al—5Ti—1B master alloy which ensures an adequate grain refining performance is claimed to comprise the following steps: melting either in an induction or electric resistance furnace; addition of premixed salts to molten aluminium in the temperature range 750° C.-800° C. at once to facilitate a rapid salt reaction, gently mixing the salts with the melt without introducing any stirring; holding the melt in the temperature range from 750° C. to 800° C. for 15 to 30 minutes; decanting the salt residue over the melt and throughly mixing the melt and casting into billets for further mechanical working into rods which does very little to improve the performance.

In order that the present invention be better understood, it will now be described in more detail with reference to the following specific, non-limiting example with reference to the accompanying drawings, wherein:

DESCRIPTION OF DRAWINGS

FIG. 1 shows the optical micrograph, at a magnification of 40:1, of the resulting Al—5Ti—1B alloy of produced in accordance with the present invention.

FIG. 2. shows the test results of the grain refaining performance gained after inoculation of the resulting Al—5Ti—1B alloy

BEST MODE

Example

Aluminium ingot with a purity of 99.7% Al was melted in a silicon carbide crucible in a medium frequency induction furnace. The $KBF_4$ and $K_2TiF_6$ salts were pre-mixed in proportions to obtain a Ti/B ratio of 5 in the melt. The salt mixture was added to the aluminium melt at once at 800° C. The reaction of the salt mixture with molten aluminium was established by gently mixing the salt mixture without introducing any stirring. The advance of the salt reaction was monitored from the temperature measurements. It took several minutes for the salt mixture to react with molten aluminium. Once the reaction was over, the crucible containing molten aluminium-titanium-boron alloy was transferred to an electric resistance furnace maintained at 800C. The molten alloy was held in the electric resistance furnace at 800C. for 30 minutes. The KAlF4 salt, the by-product of the salt reaction, is then decanted and the molten alloy in the SiC crucible is thorougly stirred with graphite rods before it was finally cast into cylindirical molds in the form of billets. These billets were finally hot extruded into 9.5 mm rods.

The invention claimed is:

1. A method to produce Al—Ti—B grain refiner master alloys with $Al_3Ti$ particles smaller than 20 microns and $TiB_2$ particles with an average size of less than 1 micron, dispersed in an aluminium matrix, comprising:

a. Melting of aluminium to form molten aluminium, b. Addition of pre-mixed $KBF_4$ and $K_2TiF_6$ salts into said molten aluminium at once to facilitate a rapid salt reaction, to form a molten alloy, and achieve 1-10% Ti and 0.2-2.0% B in said molten alloy, c. Gently mixing these halide salts with said molten aluminium without introducing any stirring, d. Holding the molten alloy after completion of the salt reaction for 15 to 120 minutes, in an electric resistance furnace, leaving molten K—Al—F salt, the by-product of the salt reaction, on the molten alloy without introducing any stirring, in order to avoid oxidation of the molten alloy, e. Decanting said molten K—Al—F salt at the end of holding, f. Casting the molten alloy into a permanent mold after stirring it thoroughly.

2. The method according to claim 1, wherein the titanium to boron ratio by weight of the resultant alloy is between 5 and 20 and the titanium and boron contents are between 1 to 10% Ti and 0.2 to 2.0% B, respectively, the balance being aluminium.

3. The method according to claim 1, wherein the $KBF_4$ and $K_2TiF_6$ salts in powder form are pre-mixed and added at once to said molten aluminium heated in an electric resistance or an electric induction furnace, to temperatures between 750° C. and 900° C.

4. The method according to claim 1, wherein the molten alloy is held at temperatures between 750° C. and 800° C. in an electric resistance furnace.

5. The method according to claim 1, wherein the titanium to boron ratio by weight is less than 5:1.

6. The method of claim 1 wherein no stirring is employed during holding in order to avoid wetting and agglomeration of the boride particles.

7. A method to produce Al—Ti—B grain refining master alloys wherein the resultant alloy contains 1 to 10% Ti, 0.2 to 2.0% B, the balance being aluminium, with $Al_3Ti$ particles smaller than 20 microns and $TiB_2$ particles with an average size of less than 1 micron, dispersed in an aluminium matrix, comprising:

a. Melting of aluminium ingot to form molten aluminium, b. Addition of pre-mixed $KBF_4$ and $K_2TiF_6$ salts into said molten aluminium heated in an electric induction or an electric resistance furnace to temperatures between 750° C. and 900° C., at once to facilitate a rapid salt reaction, to form a molten alloy, and achieve a titanium to boron ratio by weight of 5 to 20 in said molten alloy, c. Mixing these halide salts with said molten aluminium without introducing any stirring, d. Holding the molten alloy after completion of the salt reaction for 15 to 120 minutes, in an electric resistance furnace between 750° C. and 800° C., leaving molten K—Al—F salt, the by-product of the salt reaction, on the molten alloy without introducing any stirring, in order to avoid oxidation of the molten alloy, e. Decanting said molten K—Al—F salt at the end of holding, f. Casting the molten alloy into a permanent mold after stirring it thoroughly.

8. The method of claim 7 wherein no stirring is employed during holding in order to avoid wetting and agglomeration of the boride particles.

* * * * *